US009839334B2

(12) United States Patent
Casla Arruiz et al.

(10) Patent No.: US 9,839,334 B2
(45) Date of Patent: Dec. 12, 2017

(54) BODY DRIER FOR SHOWER OR BATH

(71) Applicant: LIFEAK JOB ACCOMODATION SOLUTIONS FOR LIFE, S.L., Pamplona (Navarra) (ES)

(72) Inventors: Alvaro Casla Arruiz, Pamplona (ES); Ion Esandi Mateo, Pamplona (ES); Patxi Fabo Ollobarren, Pamplona (ES); Julen Valganon Petrizan, Pamplona (ES); Carmelo Puyo Irisarri, Pamplona (ES); Joaquin Sevilla Moroder, Pamplona (ES); Jose Ramon Alfaro Lopez, Pamplona (ES)

(73) Assignee: LIFEAK JOB ACCOMODATION SOLUTIONS FOR LIFE, S.L., Pamplona (Navarra) (ES)

( * ) Notice: Subject to any disclaimer, the term of this patent is extended or adjusted under 35 U.S.C. 154(b) by 0 days.

(21) Appl. No.: 15/102,644

(22) PCT Filed: Dec. 10, 2014

(86) PCT No.: PCT/ES2014/070903
§ 371 (c)(1),
(2) Date: Jun. 8, 2016

(87) PCT Pub. No.: WO2015/086875
PCT Pub. Date: Jun. 18, 2015

(65) Prior Publication Data

US 2016/0302629 A1 Oct. 20, 2016

(30) Foreign Application Priority Data

Dec. 11, 2013 (ES) ..... 201331811

(51) Int. Cl.
*A47K 10/48* (2006.01)
*A47K 3/28* (2006.01)
*F26B 21/00* (2006.01)

(52) U.S. Cl.
CPC ..... *A47K 10/48* (2013.01); *A47K 3/281* (2013.01); *F26B 21/004* (2013.01)

(58) Field of Classification Search
CPC ..... F26B 21/004; A47K 10/48; A47K 3/281
(Continued)

(56) References Cited

U.S. PATENT DOCUMENTS 4,756,094 A * 7/1988 Houck, Jr. ..... A47K 10/48 34/225
4,780,595 A * 10/1988 Alban ..... A45D 20/16 392/364
(Continued)

FOREIGN PATENT DOCUMENTS

EP 3081129 A1 * 10/2016 ..... A47K 10/48
ES 1070751 U 10/2009
(Continued)

OTHER PUBLICATIONS

International Search Report dated Jan. 19, 2015 for PCT/ES2014/070903 and English translation.

*Primary Examiner* — Stephen M Gravin
(74) *Attorney, Agent, or Firm* — Lucas & Mercanti, LLP

(57) ABSTRACT

The invention relates to a body drier for a shower or bath, formed by a column which longitudinally defines a channel (6) on the inside thereof, said channel becoming progressively narrower from the upper part to the lower part, with a distribution of diffusion openings (7) for the outflow of air on the front part and an opening (8) on the upper part, in relation to which a mouth element (9) is arranged, to which the air outlet of a fan (10) is coupled.

7 Claims, 6 Drawing Sheets

(58) Field of Classification Search
USPC ..... 34/72
See application file for complete search history.

(56) References Cited

U.S. PATENT DOCUMENTS

| | | | | | |
|---|---|---|---|---|---|
| 4,857,705 | A * | 8/1989 | Blevins | F24H 3/0411 | 200/81.9 R |
| 4,961,272 | A * | 10/1990 | Lee | A47K 10/48 | 34/202 |
| 5,099,587 | A * | 3/1992 | Jarosch | A47K 10/48 | 34/202 |
| 5,651,189 | A * | 7/1997 | Coykendall | A47K 10/48 | 34/90 |
| 5,752,326 | A * | 5/1998 | Trim | A47K 10/48 | 34/219 |
| 5,930,912 | A * | 8/1999 | Carder | A47K 10/48 | 34/202 |
| 6,067,725 | A * | 5/2000 | Moser | A47K 10/48 | 34/223 |
| 6,131,303 | A * | 10/2000 | Roper | A47K 10/48 | 34/233 |
| 6,962,005 | B1 * | 11/2005 | Khosropour | A47K 10/48 | 34/218 |
| 7,013,504 | B2 * | 3/2006 | Brunelle | A61H 33/06 | 4/524 |
| 7,946,055 | B2 * | 5/2011 | Churchill | A47K 10/48 | 134/26 |
| 8,112,899 | B1 * | 2/2012 | Duckworth | A47K 10/48 | 34/202 |
| 8,347,521 | B2 * | 1/2013 | Churchill | A47K 10/48 | 134/26 |
| 8,438,753 | B2 * | 5/2013 | Martin | A47K 3/281 | 236/94 |
| 8,713,814 | B2 * | 5/2014 | Martin | A47K 3/281 | 236/19 |
| 9,638,463 | B2 * | 5/2017 | Cross | F26B 3/04 | |
| 2005/0111840 | A1 | 5/2005 | Craw et al. | | |
| 2016/0302629 | A1 * | 10/2016 | Casla Arruiz | A47K 10/48 | |

FOREIGN PATENT DOCUMENTS

| | | | | |
|---|---|---|---|---|
| GB | 2249263 | A | 5/1992 | |
| WO | 2009068773 | A2 | 6/2009 | |
| WO | WO 2015086875 | A1 * | 6/2015 | A47K 10/48 |

* cited by examiner

BODY DRIER FOR SHOWER OR BATH

CROSS REFERENCE TO RELATED APPLICATIONS

This Application is a 371 of PCT/ES2014/070903 filed on Dec. 10, 2014, which, in turn, claimed the priority of Spanish Patent Application No. 201331811 filed on Dec. 11, 2013, both applications are incorporated herein by reference.

FIELD OF THE ART

The present invention relates to personal hygiene and particularly to drying after a shower or bath, proposing an apparatus that allows performing integral drying of the entire body under advantageous conditions and with enormous effectiveness.

STATE OF THE ART

For drying the body after a shower or bath, the most common practice is to use towels, which is rather laborious for achieving effective, integral drying of the entire body, requiring towels to that end which, for hygienic reasons, must be used by a single person, which normally entails needing multiple towels in homes and a very large number of towels in public places such as hotels, hospitals, etc.

This involves a considerable cost for having the necessary towels available both in private homes and in public places, with an also important cost in terms of products and energy expenditure of machines for the frequent washing required to keep the towels in hygienic conditions, in addition to the time needed and the time spent by people required for that function.

In addition, the use of towels is often times complicated, even impossible, for people with disabilities, the intervention of other people who can help with using towels to dry off those people who must be dried being necessary in such cases.

Drier apparatus have been developed to solve those problems, which apparatus allow, by means of the projection of air, generally with temperature regulation, performing the drying function without having to use towels, thereby eliminating the drawbacks thereof. An apparatus of this type is, for example, the one disclosed in Spanish utility model ES 1070751U, formed by a hollow column provided with a distribution of diffusers for the outflow of air, having a fan driving a projection of air into said column, through a heating resistor, so that the air is projected out through the diffusers of the column. Said utility model contemplates shapes of the column of the drier apparatus that allow the projection of air through the diffusers in order to strike the body of a person of average height and to strike the person's head, but does not provide an effective projection of air to the foot area, so in order to complete integral drying, users have to lift their feet up, adopting uncomfortable postures and posing a risk of falling.

This problem of drying feet is exacerbated when users have disabilities, because it is extremely difficult or impossible for them to adopt the postures needed to adequately dry their feet, thereby also increasing the risk of falling.

In addition, in order to achieve optimal drying effectiveness by means of projecting air, the drier apparatus must comply with structural conditions favoring circulation of the air in order for it to uniformly flow out through the diffusers of the column and at a pressure suitable for drying, but which is not uncomfortable for the user, and these are features that the drier apparatus existing today do not comply in the manner deemed optimal.

OBJECT OF THE INVENTION

The present invention proposes a body drier apparatus which is applied for people to dry off after taking a shower or bath, having features that allow integral drying of the entire body under advantageous conditions of effectiveness and performance.

This apparatus object of the invention consists of a column which is about the average height of a person, longitudinally defining a channel on the inside thereof, which channel is closed along the side edges and at the upper and lower ends of the column and from which a distribution of openings defined with an outwardly protruding edge are open on the front part of the column; whereas on the upper part of the column an opening is defined in relation to which a mouth element is arranged, to which the fan for driving air is coupled.

An apparatus in which the fan arranged on the upper part drives an airflow that enters the column and circulates through the inside thereof in order to flow out through the openings of the front part acting as diffusers for projecting the air to the outside is thereby obtained, such that the air flowing out through said diffusion openings allows drying a user who is in front of the column of the apparatus.

The mouth element that is arranged between the fan for driving the air and the inlet opening for flowing into the column has a configuration defining an inflow of the air into the column that is virtually aligned with the inner channel thereof, which prevents head loss of the air in said inflow, taking optimal advantage of the action of the fan driving the air.

Said mouth element through which the air passes from the fan into the column has a ratio between the inlet part through which air is received from the fan and the outlet part through which air enters the column, defining the passage of air under conditions that allow being able to achieve the necessary drive of the air into the column with a lower energy expenditure of the fan for optimal functional effectiveness of the drier.

Furthermore, the inner channel of the column through which air circulates to flow out through the diffusion openings for projecting the air outwards becomes progressively narrower from top to bottom, thereby defining a compensation for the loss of speed in the circulation of the air due to the flow rate dropping as a result of the gradual outflow of air through the diffusion openings from the upper part to the lower part of the column, a uniform outflow of air through all the diffusion openings thereby being achieved.

In addition, the outwardly protruding edge of the diffusion openings is envisaged, where appropriate, according to a curved taper, with a radius of curvature and a ratio between the end aperture and the base aperture, which favors the outflow of air without any head loss, which also makes it easier to take advantage of the speed of the air circulating through the inside of the column, optimizing the functional behavior of the drier.

Additionally, in its longitudinal configuration the column is envisaged to be formed by a vertical middle segment, a forward-tilted segment in the upper part and a backward-tilted segment in the lower part, there being diffusion openings for the outflow of air in the three segments, such that the air flowing out through the diffusion openings of the vertical middle segment allows drying the user's body, the air flowing out through the diffusion openings of the tilted upper segment allows drying the user's head, and the air flowing out through the diffusion openings of the lower tilted segment allows drying the user's feet, all this taking place with the user having a normal posture standing in front of the drier apparatus, without having to adopt unnatural postures entailing a risk of falling.

The channel inside the column is envisaged to be wider in the angle between the tilted upper segment and the vertical middle segment of the column than in the rest of the channel, which in turn favors air circulating towards the vertical middle segment without head loss.

Said body drier object of the invention therefore has features making it advantageous for its intended function, being novel and preferred with respect to apparatus that are known for the same application.

DETAILED DESCRIPTION OF THE INVENTION

Figure 1:
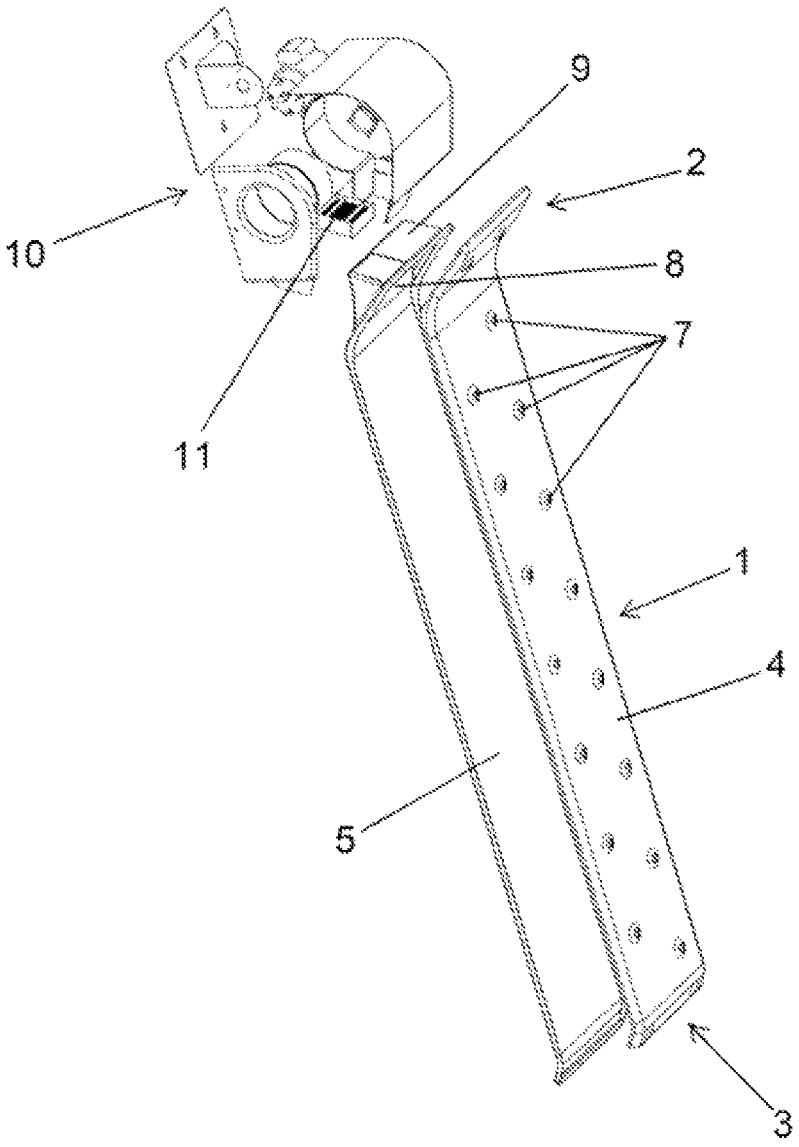
FIG. 1 shows an exploded perspective view of an embodiment of the body drier object of the invention.
Figure 2:
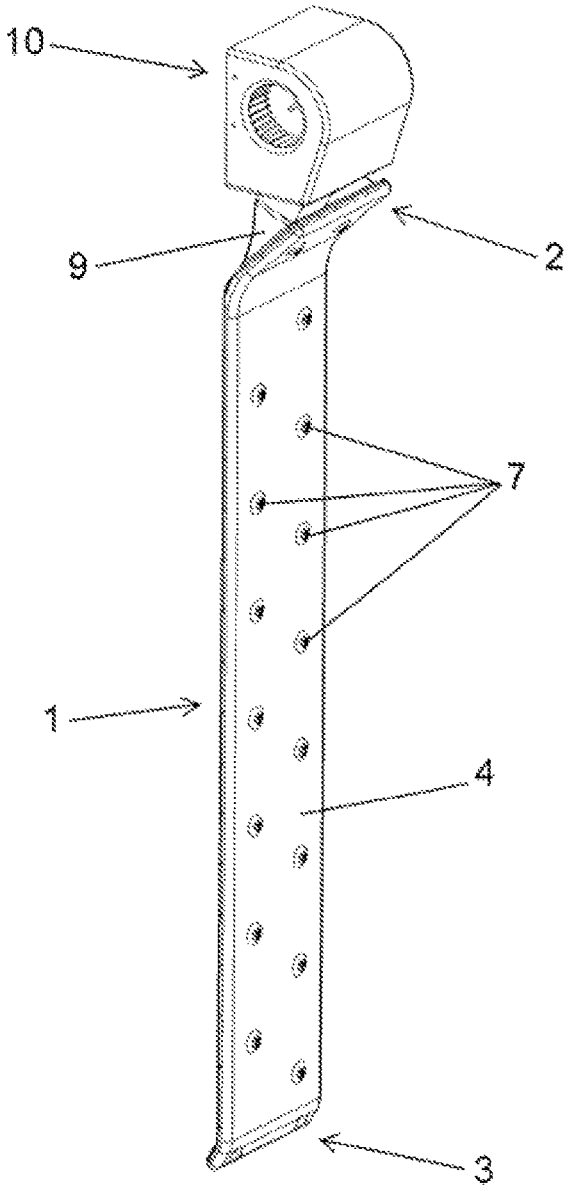
FIG. 2 is a perspective view of the body drier of the preceding figure assembled in this case, seen from the front part.
Figure 3:
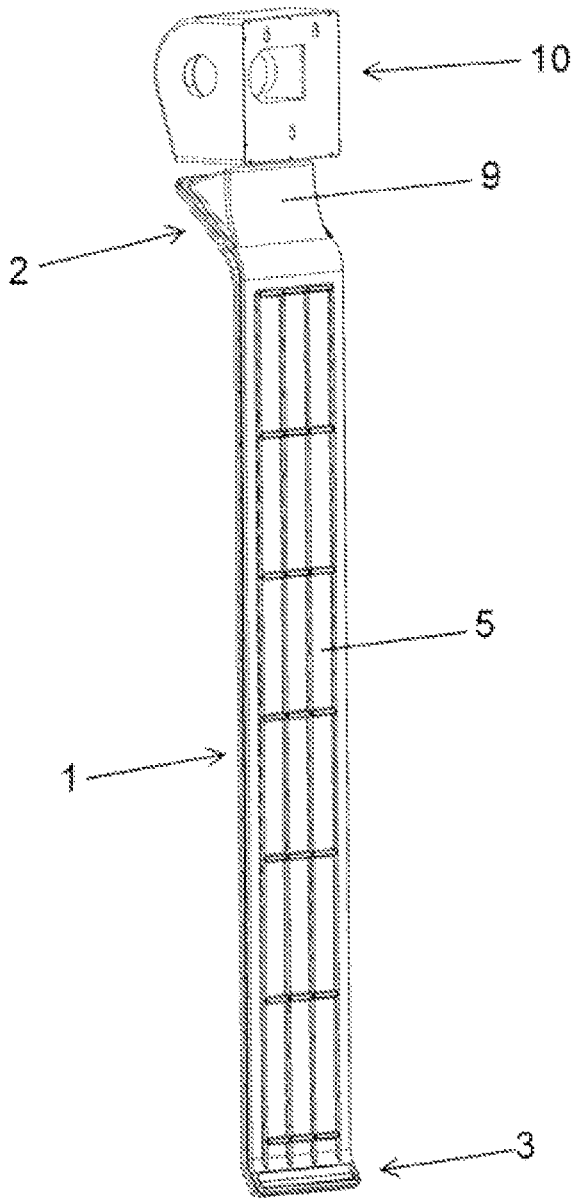
FIG. 3 is a perspective view of the same body drier seen from the back part.
Figure 4:
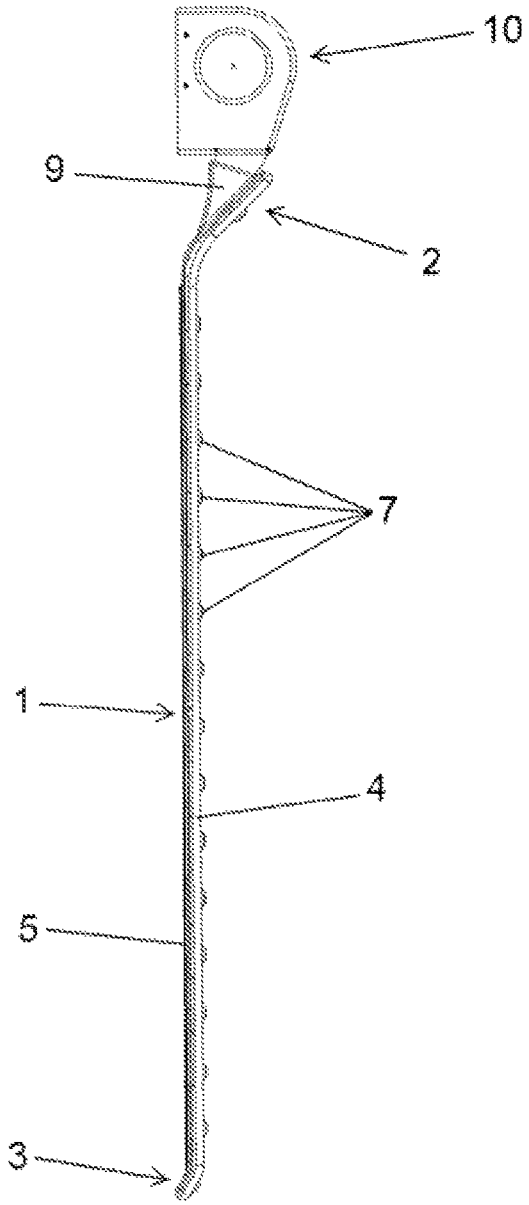
FIG. 4 is a side view of the body drier.
Figure 5:
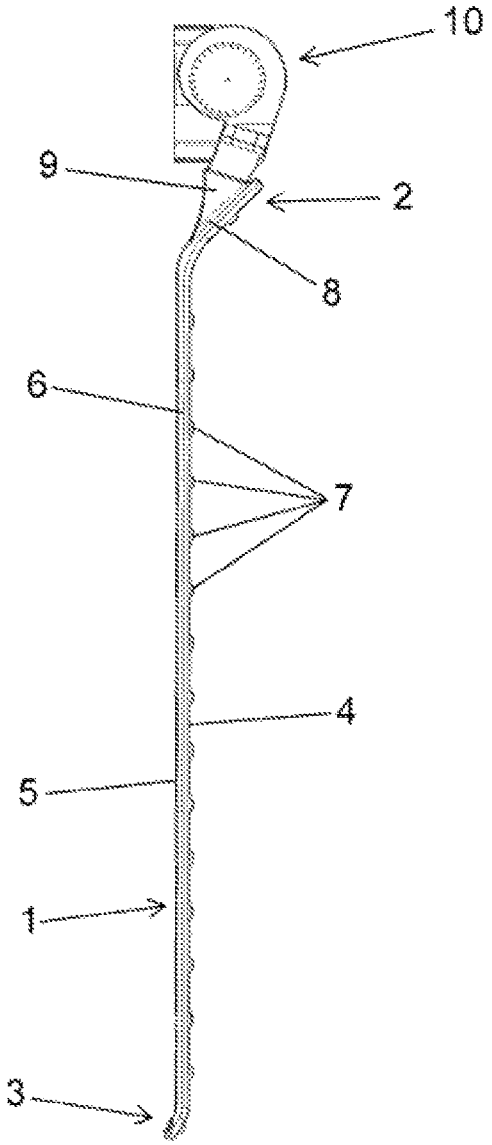
FIG. 5 is a sectioned side view of the body drier.
Figure 6:
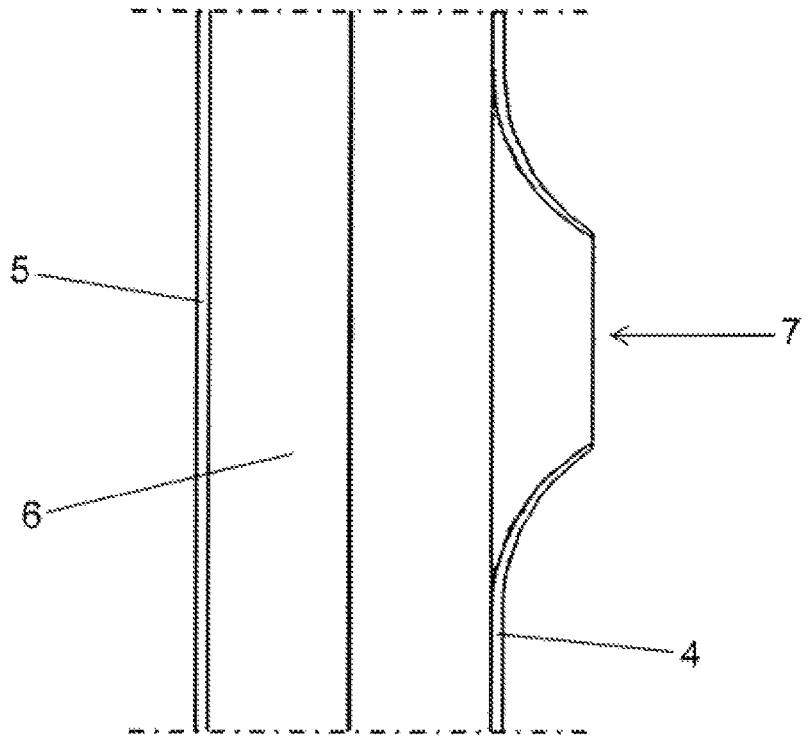
FIG. 6 is an enlarged section detail of an area in which a diffusion opening of the column of the body drier is located.

The object of the invention relates to a drier intended for drying a person's body after a shower or bath, based on projecting air that is guided towards the user, through projections oriented towards the body, the head and the feet, such that integral drying of the entire body is obtained without requiring the user to make any effort or adopt uncomfortable postures.

The proposed drier consists of a column that is the height of an average person, said column being envisaged with a longitudinal configuration formed by a vertical middle segment (1), a forward-tilted upper segment (2) and a backward-tilted lower segment (3).

According to a particular embodiment, structurally speaking, the body of the column can be formed by a front plate (4) and a back plate (5), arranged facing one another; however, said body of the column can also be formed by a one-piece element, internally defining in either case a longitudinal channel (6), which is closed along the side edges and at the ends of the column, a distribution of diffusion openings (7) forming outlets for projecting air to the outside being open from said inner channel (6), on the front part of the three segments (1, 2 and 3) of the column.

The column furthermore has an opening (8) on the upper part, in relation to which a mouth element (9) is arranged, to which the air outlet of a fan (10) is coupled, including in said coupling one or more heating resistors (11) the activation of which is selectively controlled in combination with the operation of the fan (10).

An apparatus is thereby obtained in which an airflow is driven through the mouth element (9) towards the inner channel (6) of the column by means of the fan (10), the airflow circulating through said inner channel (6) to flow out by being projected through the diffusion openings (7), such that the air that flows out projected through the diffusion openings (7) of the vertical middle segment (1) can strike the body of a user standing in front of the apparatus, whereas the air that flows out projected through the diffusion openings (7) of the forward-tilted upper segment (2) strikes the head of the user and the air that flows out projected through the diffusion openings (7) of the backward-tilted lower segment (3) strikes the feet of the user; thereby directly achieving integral drying of the entire body of the user by means of the air that is projected out.

The effectiveness of the drying and the functional performance of the apparatus for that function essentially depend on the conditions of the projection of the air through the diffusion openings (7), which conditions, in turn, depend on the drive provided by the fan (10) and on the circulation of the airflow from the outlet of the fan (10) to the outlet for projection through the diffusion openings (7).

In that sense, the mouth element (9) through which the air passes from the fan (10) to the inner channel (6) of the column of the drier apparatus is defined with a ratio between the section of the inlet through which it receives the air from the fan (10) and the section of the outlet through which the air passes into inner channel (6) of the column in a range between 18% and 25%, and particularly 23.6%, whereby achieving conditions for the passage of air which favor taking advantage of the drive of the fan (10).

The inner channel (6) is wider in the angle between the vertical middle segment (1) and the forward-tilted upper segment (2) than the rest of said inner channel (6), whereby achieving circulation of the air through the inner channel (6) virtually without head loss; this is also aided by the fact that the projection of the air driven by the fan (10), in the inlet into the inner channel (6) of the column, through the mouth element (9), is virtually aligned with said inner channel (6) of the column.

In addition, the section of the inner channel (6) for the circulation of air becomes progressively narrower from the upper part to the lower part of the column, which allows compensating for the loss of speed of the air due to the flow rate gradually dropping as a result of the outflow of part of the air through the diffusion openings (7) from the upper part to the lower part.

In order to achieve an outflow of air projected through the diffusion openings (7) such that it is effective for the drying function and with optimal performance of the operation of the fan (10) for driving the air, the ratio between the section for the passage of air from the fan (10) to the mouth element (9) and the section for the outflow of air through the set of diffusion openings (7) is defined in a range between 42% and 50%, said ratio particularly being envisaged to be 47%.

In order to improve the outflow of air that is projected out, the diffusion openings (7) are defined with an outwardly protruding edge, according to a taper with a curved wall with a radius of curvature between 10 millimeters and 20 millimeters, particularly 15 millimeters, and with a ratio between the end aperture section and the base aperture section in a range between 32% and 42%, and particularly 38%, whereby achieving an outflow of air that is projected without head loss and with an increase in speed, favoring performance.

For the purpose of mounting the drier apparatus, the mouth element (9) is envisaged to have an elongated configuration between the part that is coupled with the fan (10) and the part that is coupled with the opening (8) in communication with the inner channel (6) of the column, thereby allowing an installation of the drier apparatus in which the fan (10) can be concealed in a suspended ceiling.

The invention claimed is:

1. A body drier for a shower or bath comprising:

a column having a front side and a back side, a vertical middle segment, an upper forward tilting segment and a lower backward tilting segment, the column has an opening on the back side of the upper forward tilting segment and is closed on a lower end of the lower backward tilting segment;

an inner cavity channel inside the column which is progressively narrower from the upper segment to the lower segment of the column;

a mouth element arranged on the back side of the upper forward tilting segment of the column;

a fan driving forced airflow coupled to said mouth element;

a plurality of diffusion openings forming outlets for projecting forced airflow are arranged throughout the front side of the column, wherein the plurality of diffusion openings on the upper forward tilting segment of the column projects forced airflow towards the head of a user and the plurality of diffusion openings on the lower backward tilting segment projects forced airflow towards the feet of the user.

2. The body drier for a shower or bath according to claim 1, wherein a ratio between a section for the passage of air from the fan to the mouth element and a section for an outflow of air through the plurality of diffusion openings is comprised in a range between 42% and 50%.

3. The body drier for a shower or bath according to claim 2, wherein the ratio between the section for the passage of air from the fan to the mouth element and the section for the outflow of air through the plurality of diffusion openings is 47%.

4. The body drier for a shower or bath according to claim 1, wherein an inner conduit of the column is wider in the angle between the vertical middle segment and the forward-tilted upper segment than in the rest of said inner channel.

5. The body drier for a shower or bath according to claim 1, wherein each of the plurality of diffusion openings has an outwardly protruding edge, according to a taper with a curved wall with a radius of curvature between 10 millimeters and 20 millimeters, and with a ratio between an end aperture section and a base aperture section between 32% and 42%.

6. The body drier for a shower or bath according to claim 5, wherein the radius of curvature is 15 millimeters and the ratio between the end aperture section and the base aperture section is 38%.

7. A body drier for a shower or bath comprising:

a column comprising a front plate having a forward-tilted upper segment and a backward-tilted lower segment, and a back plate having a corresponding forward-tilted upper segment and a corresponding backward-tilted lower segment arranged facing one another;

an inner cavity channel inside the column which is progressively narrower from the upper segment to the lower segment of the column;

a mouth element arranged on the back side of the upper forward tilting segment of the column;

a fan driving forced airflow coupled to said mouth element;

a plurality of diffusion openings forming outlets for projecting forced airflow are arranged throughout the front side of the column, wherein the plurality of diffusion openings on the upper forward tilting segment of the column projects forced airflow towards the head of a user and the plurality of diffusion openings on the lower backward tilting segment projects forced airflow towards the feet of the user.

* * * * *